United States Patent [19]

Tsuchiya

[11] Patent Number: 4,780,397

[45] Date of Patent: Oct. 25, 1988

[54] PROCESS FOR PREPARING FILM POSITIVE SHEETS FOR FORGING-BY-COPYING-PROOF PRINTS AND PRINTS THEREFROM

[75] Inventor: Shohei Tsuchiya, Tokyo, Japan

[73] Assignee: Hosokawa Printing Co., Ltd., Tokyo, Japan

[21] Appl. No.: 897,373

[22] Filed: Aug. 18, 1986

[51] Int. Cl.[4] ..... G03C 5/00

[52] U.S. Cl. ..... 430/394; 430/10; 430/396; 430/494; 430/952; 101/468; 283/57; 283/67; 283/93; 283/902

[58] Field of Search ..... 430/394, 396, 10, 494, 430/952; 283/67, 93, 902, 57, 58, 59, 74, 113; 101/468

[56] References Cited

U.S. PATENT DOCUMENTS

| | | | |
|---|---|---|---|
| 1,002,600 | 9/1911 | Morris et al. | 283/902 X |
| 3,675,948 | 7/1972 | Wicker | 283/902 X |
| 4,168,088 | 9/1979 | Somlyody | 283/902 X |
| 4,175,774 | 11/1979 | Tonges et al. | 283/902 X |
| 4,210,346 | 7/1980 | Mowry, Jr. et al. | 283/902 X |
| 4,227,720 | 10/1980 | Mowry, Jr. et al. | 283/902 X |
| 4,265,469 | 5/1981 | Mowry, Jr. et al. | 283/902 X |
| 4,310,180 | 1/1982 | Mowry, Jr. et al. | 283/902 X |
| 4,341,404 | 7/1982 | Mowry, Jr. et al. | 283/902 X |
| 4,351,547 | 9/1982 | Brooks, II | 283/902 X |
| 4,579,370 | 4/1986 | Corwin et al. | 283/72 |
| 4,582,346 | 4/1986 | Caprio et al. | 283/94 |
| 4,668,597 | 5/1987 | Merchant | 430/22 |

*Primary Examiner*—José G. Dees

*Attorney, Agent, or Firm*—Wenderoth, Lind & Ponack

[57] ABSTRACT

There is provided a process for preparing a film positive sheet for a forging-by-copying-proof print in which a first background image sheet is placed on a first latent image sheet, an unexposed film having a photosensitive membrane on the undersurface is placed on the background sheet to provide a primary three-layer film structure, the three-layer film structure is illuminated to partially expose the film, the first latent image and background sheets are replaced by second latent image and second background sheets, respectively, to provide a secondary three-layer film structure, the secondary three-layer film structure is illuminated to completely expose the partially exposed film and the second latent image and background sheets are removed from the secondary three-layer structure to thereby provide a film positive sheet for a forging-by-copying-proof print.

2 Claims, 2 Drawing Sheets

PROCESS FOR PREPARING FILM POSITIVE SHEETS FOR FORGING-BY-COPYING-PROOF PRINTS AND PRINTS THEREFROM

BACKGROUND OF THE INVENTION

This invention relates to a process for preparing film positive sheets and more particularly, to a process for preparing film positive sheets for prints bearing latent images which are normally invisible with the naked eye, but developed on copies of prints made from the film positive sheets whereby abuse of the prints such as forging or alternating thereof by copying machines can be prevented.

In order to prevent that important documents such as securities and secret documents are copies with intention of abuse, it has been proposed that warning marks such as "VOID" and the like that are invisible with the naked eye be previously printed on the documents yet distinguishable from the surrounding background when the documents are copied.

One proposal to date for attaining the above-mentioned purpose is a document in which the background is formed of fine meshes of a given size, and the warning mark is formed of meshes of a size different from that of the meshes forming the background. Each of the background and warning mark has a camouflage pattern incorporated therein so that the background and warning mark cannot be easily distinguished from each other with the naked eye.

Such prior art is disclosed in U.S. Pat. No. 4,265,459. Although the prior art provides the effect that the incorporation of the camouflage pattern in the warning mark makes it difficult notice of the presence of the warning mark with the naked eye, the prior art has not been widely applied because of the disadvantages which will be described hereinbelow.

First of all, the prior art is disadvantageous in that when the document is copied, the warning mark cannot be clearly noted on the obtained copy. That is, as the background and warning mark in the document are formed of circular meshes, it is required that one of the background and warning mark be formed of meshes having a size and the other of the background and warning mark be formed of meshes having a size different from the meshes forming the former. However, when the difference in mesh size is extremely great, even if the background and warning mark have camouflage patterns incorporated therein, there is the possibility that the warning mark may be identified with the naked eye. Thus, it has been contemplated that the meshes forming one of the background and warning mark be made larger than those forming the other of the background and warning mark in such a size relationship that the size of the larger meshes is a multiple of that of the smaller meshes whereby when the document is copied by a copying machine, the larger meshes are reproduced, but the smaller meshes are not reproduced in the obtained copy. However, with the multiple mesh size relationship between the larger and smaller size meshes, the size difference will not appear distinctly on the copy obtained from the document. Especially, because with rapid development of copying machine technology, the copy color adjusting range has been increased and presents the problem that the background and warning mark will be reproduced on document copies in substantially the same color tone.

And in the prior art described above, because the camouflage patterns as well as the background and warning mark are printed by a single screen, the camouflage patterns, warning mark and background lie in the same plane and do not exhibit any random appearance having decorative effects. Thus, prints or documents sometime have undesirable appearances and are not practical.

It is clear that the above-mentioned disadvantages are owing to processes for preparing film positive sheets from which prints or document are prepared.

SUMMARY OF THE INVENTION

According to one aspect of the present invention, there is provided a process for preparing a film positive sheet for a forging-by-copying-proof print which comprises the steps of providing a latent image negative, placing a multi-line negative on the upper surface of said latent image negative, placing an unexposed film having a photosensitive membrane on the undersurface thereof on the upper surface of said multi-line negative to provide a primary three-layer film structure, striking light from a light source against the undersurface of said primary three-layer film structure to partially expose said unexposed film so as to form a primary film positive sheet, replacing said latent image negative by a latent image positive and said multi-line negative by a mesh negative, respectively, to form a secondary three-layer film structure, striking light from said light source against the undersurface of said secondary three-layer film structure to completely expose said partially exposed film and removing said latent image positive and mesh negative from said secondary three-layer film structure to thereby provide a film positive sheet for a forging-by-copying-proof print.

According to another aspect of the present invention, there is provided a process for preparing a film positive sheet for a forging-by-copying-proof print which comprises the steps of providing a latent image positive, placing a multi-line negative on the upper surface of said latent image positive, placing an unexposed film having a photosensitive membrane on the undersurface thereof on the upper surface of said multi-line negative to form a primary three-layer film structure, striking light from said light source against the undersurface of said primary three-layer film structure to partially expose said film to provide a primary film positive sheet, replacing said latent image positive by a latent image negative and said multi-line negative by a mesh negative, respectively, to form a secondary three-layer film structure, striking light from said light source against the undersurface of said secondary three-layer film structure to completely expose said partially exposed film and removing said latent image and mesh negative from said secondary three-layer film structure to thereby provide a film positive sheet for a forging-by-copying-proof print.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENTS OF THE INVENTION

The present invention will be now described referring to the accompanying drawings which show one preferred embodiment of the present invention for illustration purpose.

Figure 1:
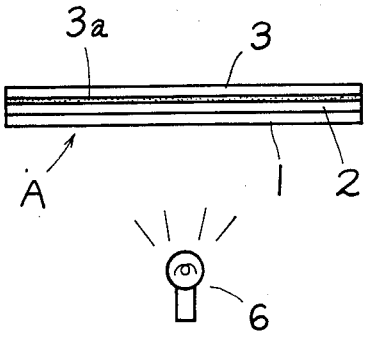
FIG. 1 is a side elevational view showing a first exposure step in the process according to the present invention.
Figure 2:
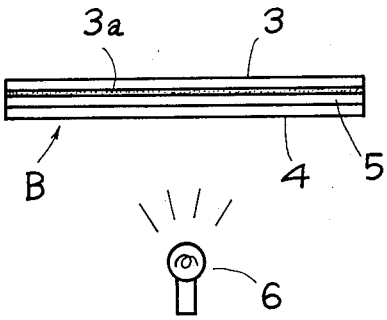
FIG. 2 is a side elevational view showing a second explosure step in the process according to the present invention.
Figure 3:
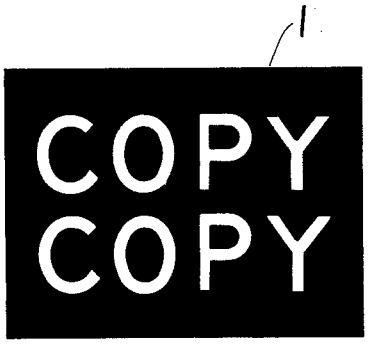
FIG. 3 is a plan view of a latent image negative employed in the process according to the present invention.
Figure 7:
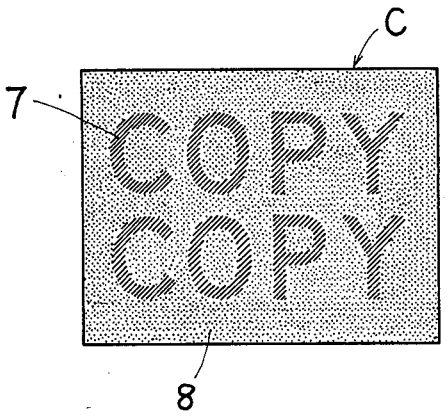
FIG. 7 is a plan view of a film positive sheet produced by the process according to the present invention.
Figure 8:
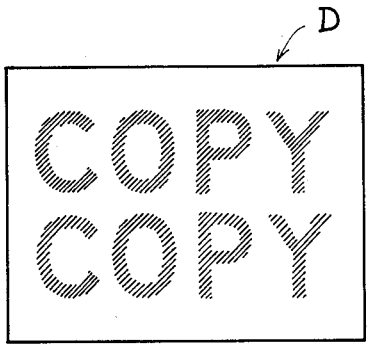
FIG. 8 is a plan view of a copy of a print prepared by the employment of the film positive sheet as shown in FIG. 7.

In FIG. 1, reference numeral 1 denotes a latent image negative having two blank "COPY" images surrounded by the black background thereon and a multi-line negative 2 is placed on the upper surface of the latent image negative 1 and has 50 (fifty) lines extending at 45° with respect to the longitudinal axis of the negative covering 90% of the area of the negative. An unexposed film 3 having a photosensitive membrane 3*a* on the undersurface is placed on the upper surface of the multi-line negative 2 to thereby provide a primary three-layer film structure A. In a first exposure step in the process according to the present invention, a light source 6 is energized to strike light against the undersurface of the primary three-layer film structure A to partially expose the photosensitive membrane 3*a* whereupon the two blank "COPY" images on the latent image negative 1 are developed on the photosensitive membrane 3*a* as multi-line images of 50-line 10% area. Furthermore, after the first exposure step, the latent image negative 1 of the primary three-layer film structure A is replaced by a latent image positive 4 and the multi-lane negative 2 is replaced by a mesh negative 5 of 150-line 90% area, respectively, to provide a secondary three-layer film structure B. Thereafter, the light source 6 is again energized to strike light against the undersurface of the secondary three-layer film structure B in the same manner as the first explosure step to completely expose the photosensitive membrane 3*a* whereupon meshes of 150-line 10% area are developed in the region of the photosensitive membrane 3*a* of the film 3 other than the region where the two multi-line "COPY" images were developed in the first explosure step whereby a film positive sheet C having the multi-line latent images 7 and the mesh background 8 as shown in FIG. 7 is obtained. When printing is performed on a sheet of paper employing the film positive sheet C, the latent image consisting of 50-line 10% area and the background consisting of 150-line 10% area are formed on the sheet of paper. When the thus printed sheet of paper is copied by a copying machine, as shown in FIG. 8, the multi-lines are reproduced in deep color on the copy D, but the meshes are not reproduced on the copy and thus the two "COPY" images can be clearly seen.

Figure 9:
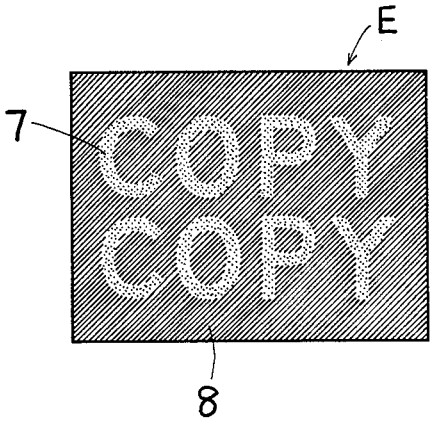
FIGS. 9 and 10 are plan views of film positive sheets produced by the process according to the present invention.

When the latent image negative 1 in the primary three-layer film structure A is replaced by the latent image positive 4 and the modified three-layer film structure is subjected to the first exposure and the latent image positive 4 in the secondary three-layer film structure B is replaced by the latent image negative 1 and the resulting three-layer film structure is subjected to the second exposure, the film positive sheet E as shown in FIG. 9 is obtained. That is, by reversing the operation procedure in the embodiment described above, the latent image 7 are formed of meshes of 150-line 10% area and the background 8 is formed of multi-lines of 50-line 10% area. Thus, when a print is prepared by the film positive sheet E is copied by a copying machine, the meshes are not reproduced on the obtained copy, but the multi-lines are reproduced in deep color on the copy and thus, the blank "COPY" images can be clearly seen.

Figure 4:
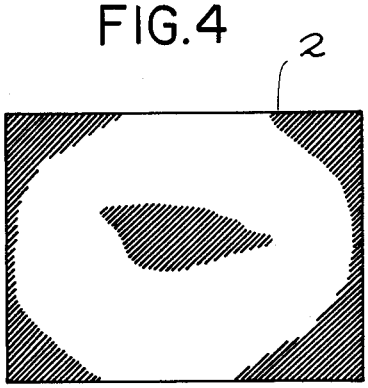
FIG. 4 is a plan view of a multi-line negative employed in the process according to the present invention.
Figure 5:
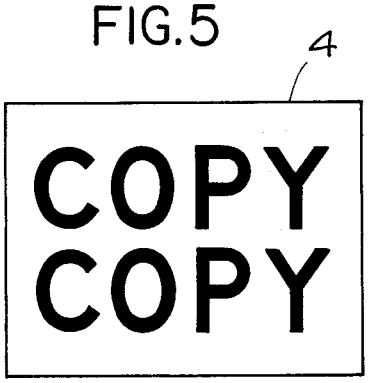
FIG. 5 is a plan view of a latent image positive employed in the process according to the present invention.
Figure 6:
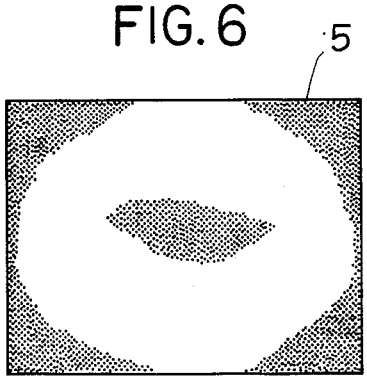
FIG. 6 is a plan view of a mesh negative employed in the process according to the present invention.
Figure 10:
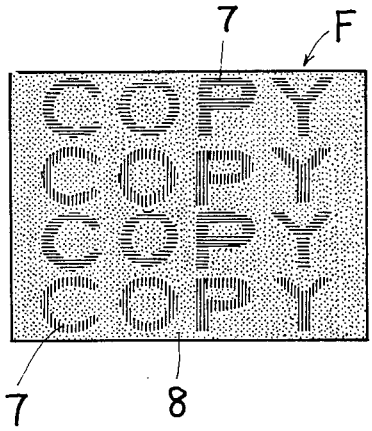

The inclination of the lines on the multi-line negative 2 may be 90° or parallel to the longitudinal axis of the negative other than 45° as shown in FIG. 4 depending upon the direction of light emitting from the copying machine and, furthermore, when the latent images 7 appear in multi-lines at a greater number of areas, the film positive sheet is preferably produced as comprising a combination of multi-lines extending at 90° and parallel to the longitudinal axis of the sheet as more clearly shown in FIG. 10.

The process of the present invention provides the following particular effects:

A. As the multi-line negative 2 and the mesh negative 5 are employed in the preparation of a film positive sheet, the latent images 7 and background 8 are formed in multi-lines and meshes, respectively, on the obtained film positive sheet. Thus, a print prepared by the employment of the film positive sheet similarly comprises the combination of multi-lines and meshes and when a print is prepared by the employment of the film positive sheet and the print is copied, the background and latent images on the obtained copy can be clearly distinguished from each other, and even when the light intensity of the copying machine is varied, there is no possibility that the boundary between the background and latent images become obscure. In other words, because the mesh negative 5 has about 150 lines covering the area on the order of 90% thereof, the lines are not reproduced by the ordinary light intensity of the copying machine, thus leaving the mesh negative 5 blank. On the other hand, because the multi-line negative has about 50 lines covering the area on the order of 90% of the negative, the lines on the negative can be reproduced in deep color by a conventional copying machine with the normal light intensity of the machine and regardless of variation in the light intensity of the machine. This is owing to the phenomena that the multi-lines are printed in a continuous pattern different from the meshes and that the multi-lines have the adaptability to the light emitting direction of the copying machine.

B. The film positive sheet, such as shown in FIGS. 7, 9, and 10, comprises the latent images 7 formed of multi-lines and the background 8 formed of meshes, and thus, the surfaces of a print prepared by the employment of the film positive sheet are smooth and present a decent appearance. Furthermore, the presence of the latent images on the print cannot be seen with the naked eye. In short, because the multi-lines are irregular in length in conformity with the contours of the latent images, the multi-lines have an effect which dazzles the naked eye and thus, the latent images are not viewed even when no camouflage pattern is incorporated in the film positive sheet.

C. When the inclination angle of the lines on the multi-line negative 2 is 45° with respect to the longitudinal axis of the negative and placed on a duplicator, even if an article to be printed is set in any orientation on the duplicator, the lines on the multi-line negative 2 can be reproduced having the same depth on the obtained print. Alernatively, when the lines on the multi-line negative 2 are orientated at 90° or parallel to the longitudinal axis of the negative, the lines extending in the direction in conformity with the light emitting direction of the duplicator can be more clearly reproduced on the obtained print.

As more clearly shown in FIG. 10, when a greater number of latent images 7 are provided on the latent image negative 1, if the lines on the multi-line negative 2 are orientated in a combination of 90° and parallel to the longitudinal axis of the multi-line negative 2, the latent images in multi-lines in the direction in conformity with the light emitting direction of the duplicator or copying machine are conspicuously reproduced on an article to be printed regardless of the orientation of the article to be printed on the copying machine.

D. As mentioned hereinabove, when a copy is made from the print prepared by employing the film positive sheet embodying the present invention, the copy has the latent images quite clearly developed as positive images thereon, and thus, when a light color pattern which is not easily reproduced is printed over the latent image, although the pattern is faintly reproduced on a copy of the overprinted product, the latent image is fully visual. Thus, there is a practical advantage that a print having a decorative pattern thereon can be obtained. And even when the film positive sheet prepared by the process according to the present invention has a camouflage pattern incorporated therein, the latent images or image on a copy obtained by a copying machine employing the film positive sheet can be more clearly developed, as compared with the latent images on copies obtained employing film positive sheets prepared by conventional processes, and the incorporation of the camouflage pattern into the film positive sheet is also within the scope of the present invention.

While preferred embodiments of the invention have been shown and described in detail, it will be understood that the same are for illustration purposes only and not to be taken as a definition of the scope of the invention, which scope is defined by the appended claims.

What is claimed is:

1. A process for preparing a film positive sheet for a forging-by-copying-proof print comprising the steps of providing a latent image negative, placing a multi-line negative on the upper surface of said latent image negative, placing an unexposed film having a photosensitive membrane on the undersurface thereof on the upper surface of said multi-line negative to form a primary three-layer film structure, striking light from a light source against the undersurface of said primary three-layer film structure to partially expose said unexposed film so as to provide a primary film positive sheet, replacing said latent image negative by a latent image positive and said multi-line negative by a mesh negative, respectively, to form a secondary three-layer film structure, striking light from said light source against the undersurface of said secondary three-layer film structure to completely expose said partially exposed film and removing said latent image positive and mesh negative from said secondary three-layer film structure to thereby provide a film positive sheet for a forging-by-copying-proof print.

2. A process for preparing a film positive sheet for a forging-by-copying-proof print comprising the steps of providing a latent image positive, placing a multi-line negative on the upper surface of said latent image positive, placing an unexposed film having a photosensitive membrane on the undersurface thereof on the upper surface of said multi-line negative to form a primary three-layer film structure, striking light from a light source against the undersurface of said primary three-layer film structure to partially expose said unexposed film to provide a primary film positive sheet, replacing said latent image positive by a latent image negative and said multi-line negative by a meseh negative, respectively, to form a secondary three-layer film structure, striking light from said light source against the undersurface of said secondary three-layer film structure to completely expose said partially exposed film and removing said latent image and mesh negatives from said secondary three-layer film structure to thereby provide a film positive sheet for a forging-by-copying-proof print.

* * * * *